US005802710A

United States Patent [19]

Bufanda et al.

[11] Patent Number: 5,802,710

[45] Date of Patent: Sep. 8, 1998

[54] METHOD OF ATTACHING A CONNECTOR TO A COAXIAL CABLE AND THE RESULTING ASSEMBLY

[75] Inventors: Daniel E. Bufanda, Bolingbrook; John H. Dykstra, Tinley Park; Jeff A. Ferdina, Hanover Park, all of Ill.

[73] Assignee: Andrew Corporation, Orland Park, Ill.

[21] Appl. No.: 736,449

[22] Filed: Oct. 24, 1996

[51] Int. Cl.[6] ..... H01B 13/20

[52] U.S. Cl. ..... 29/828; 439/578; 439/584

[58] Field of Search ..... 29/828; 439/584, 439/585, 578

[56] References Cited

U.S. PATENT DOCUMENTS

| | | | |
|---|---|---|---|
| 3,199,061 | 8/1965 | Johnston et al. . | |
| 3,291,895 | 12/1966 | Van Dyke | 174/88 |
| 3,394,400 | 7/1968 | Lamons | 174/102 |
| 3,461,409 | 8/1969 | Miller | 333/96 |
| 3,761,844 | 9/1973 | Reeder | 439/578 X |
| 4,046,451 | 9/1977 | Juds et al. . | |
| 4,109,222 | 8/1978 | Frano et al. . | |
| 4,161,816 | 7/1979 | Frano et al. . | |
| 4,800,351 | 1/1989 | Rampalli et al. | 333/237 |
| 4,910,998 | 3/1990 | Willis et al. | 73/40.5 R |
| 5,021,010 | 6/1991 | Wright | 439/578 |
| 5,063,659 | 11/1991 | Wright | 29/860 |
| 5,110,308 | 5/1992 | Nishikawa et al. | 439/582 |
| 5,137,470 | 8/1992 | Doles | 439/578 |
| 5,154,636 | 10/1992 | Vaccaro et al. | 439/583 |
| 5,167,533 | 12/1992 | Rauwolf | 439/583 |
| 5,207,596 | 5/1993 | Tran | 439/578 |
| 5,232,377 | 8/1993 | Liebfried, Jr. . | |
| 5,281,167 | 1/1994 | Le et al. . | |
| 5,334,051 | 8/1994 | Devine et al. | 439/583 |
| 5,354,217 | 10/1994 | Gabel et al. | 439/578 |
| 5,422,614 | 6/1995 | Rampalli et al. | 333/237 |
| 5,435,745 | 7/1995 | Booth | 439/584 |
| 5,480,325 | 1/1996 | Tran et al. . | |
| 5,558,538 | 9/1996 | Delalle | 29/828 X |
| 5,561,900 | 10/1996 | Hosler, Sr. | 29/828 |

FOREIGN PATENT DOCUMENTS

| | | | |
|---|---|---|---|
| 0 449 817 B1 | 5/1993 | European Pat. Off. . | |
| 0 576 785 A2 | 5/1994 | European Pat. Off. . | |
| 92017 923 | 10/1992 | WIPO | 439/874 |

OTHER PUBLICATIONS

Drawing of Telegartner Connector.

*Primary Examiner*—Carl J. Arbes
*Attorney, Agent, or Firm*—Arnold, White & Durkee

[57] ABSTRACT

A method of attaching a connector to a coaxial cable having concentric inner and outer conductors comprises the following steps. An end of the cable is prepared to expose a portion of the inner conductor and to expose a portion of the outer conductor. An insulative disc of the connector is installed onto the exposed portion of the inner conductor. An inner contact of the connector is installed onto the exposed portion of the inner conductor. A solder preform is installed onto the exposed portion of the outer conductor. A body member of the connector is installed over the solder preform onto the exposed portion of the outer conductor. To complete the cable assembly, the solder preform is melted to firmly attach the body member of the connector to the exposed portion of the outer conductor of the cable.

18 Claims, 4 Drawing Sheets

METHOD OF ATTACHING A CONNECTOR TO A COAXIAL CABLE AND THE RESULTING ASSEMBLY

FIELD OF THE INVENTION

The present invention relates generally to coaxial cable connectors and coaxial cables and, more particularly, relates to a method for attaching a connector to a coaxial cable and the resulting assembly.

BACKGROUND OF THE INVENTION

A coaxial cable assembly is comprised of the combination of a connector and a coaxial cable. The connector is attached to a prepared end of the coaxial cable. The coaxial cable includes inner and outer conductors, and the connector typically includes a body member that is electrically connected to the outer conductor and an inner contact or pin that is electrically connected to the inner conductor. To effectuate electrical contact between the inner contact of the connector and the inner conductor of the cable, the inner contact may be soldered or engaged in some other fashion to the inner conductor. To effectuate electrical contact between the body member of the connector and the outer conductor of the cable, a clamping member is locked to the prepared end of the coaxial cable and the body member is clamped to the clamping member with both the clamping member and the body member bearing against opposite sides of the outer conductor.

The foregoing clamping technique for engaging the body member of the connector to the outer conductor of the cable makes the manufacturing process labor intensive and time-consuming and requires the use of a clamping member to establish electrical contact between the body member of the connector and the outer conductor of the cable. The use of the clamping member adds a somewhat weighty and expensive component to the cable assembly, thereby increasing the size and manufacturing cost of the cable assembly.

SUMMARY OF THE INVENTION

An object of the present invention is to provide a method of quickly and easily attaching a connector to a coaxial cable without the use of a clamping member. A related object is to provide such a method and a resulting cable assembly that require fewer weighty and expensive components than the aforementioned clamping technique.

Another object of the present invention is to provide a cable assembly that exhibits excellent intermodulation stability and electrical and mechanical performance.

A further object of the present invention is to provide a method of attaching a connector to a coaxial cable that allows the depth of the inner contact relative to the body member of the connector to be easily controlled. A related object is to provide a resulting cable assembly wherein the depth of the inner contact relative to the body member of the connector is consistent from one assembly to the next.

Yet another object of the present invention is to provide a method of attaching a connector to a coaxial cable that provides a moisture barrier between the cable and the connector without the use of rubber O-rings, thereby protecting the connector from detrimental environmental conditions.

Other objects and advantages of the invention will become apparent upon reading the following detailed description and upon reference to the drawings.

In accordance with one aspect of the present invention, the foregoing objectives are realized by providing an improved method of attaching a connector to a coaxial cable comprising the following steps. An end of the cable is prepared to expose a portion of the inner conductor and to expose a portion of the outer conductor. An insulative disc of the connector is installed onto the exposed portion of the inner conductor. An inner contact of the connector is installed onto the exposed portion of the inner conductor. A solder preform is installed onto the exposed portion of the outer conductor. A body member of the connector is installed over the solder preform onto the exposed portion of the outer conductor. To complete the cable assembly, the solder preform is melted to firmly attach the body member of the connector to the exposed portion of the outer conductor of the cable.

In accordance with another aspect of the present invention, the foregoing objectives are realized by providing the cable assembly resulting from the aforementioned method.

Figure 1:
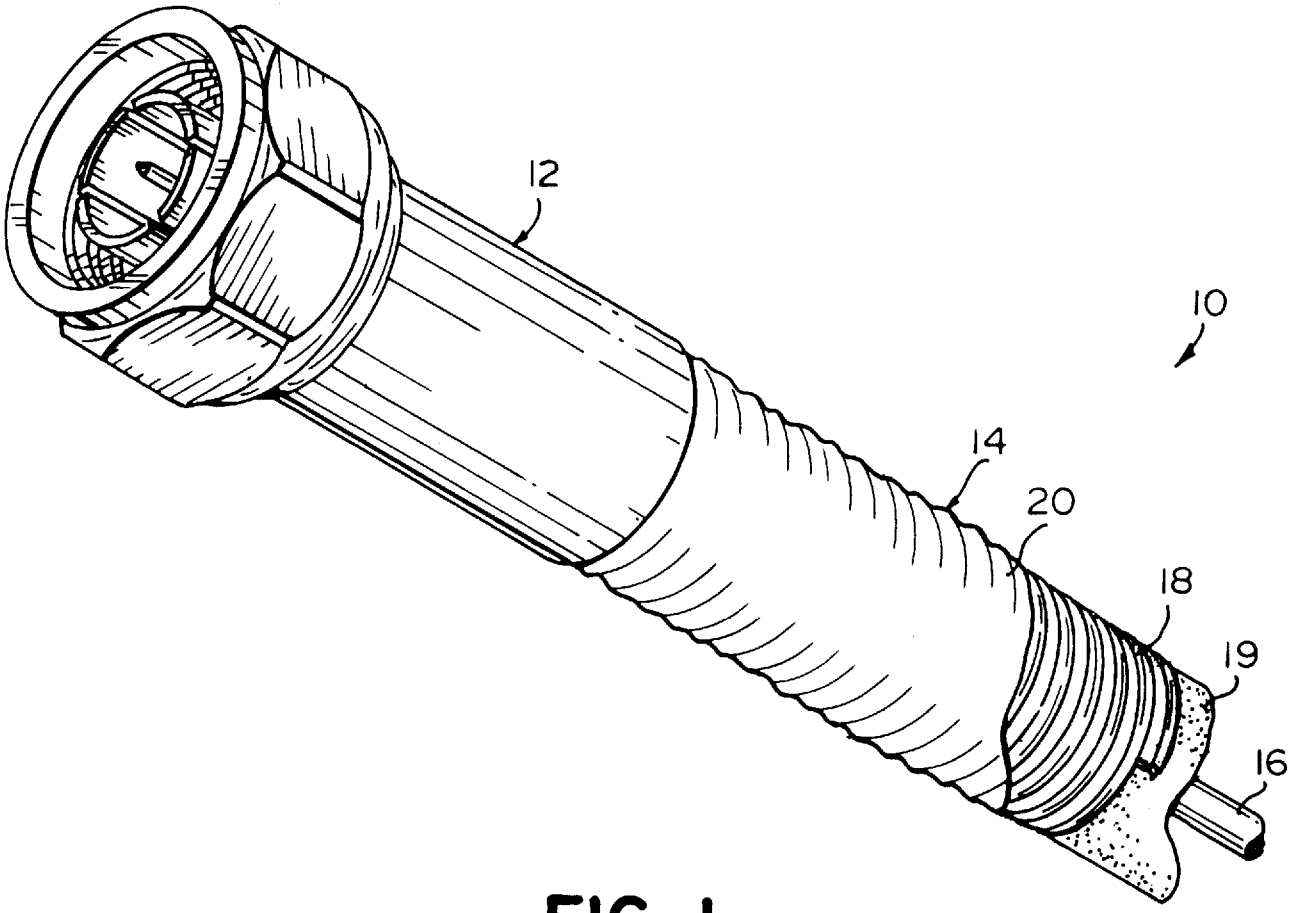
FIG. 1 is an isometric view of a cable assembly embodying the present invention with portion broken away to show internal structure.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Turning now to the drawings, FIG. 1 illustrates a coaxial cable assembly 10 embodying the present invention. The coaxial cable assembly 10 is comprised of the combination of a connector 12 and a coaxial cable 14. The connector 12 is firmly attached to a prepared end of the coaxial cable 14.

Figure 2:
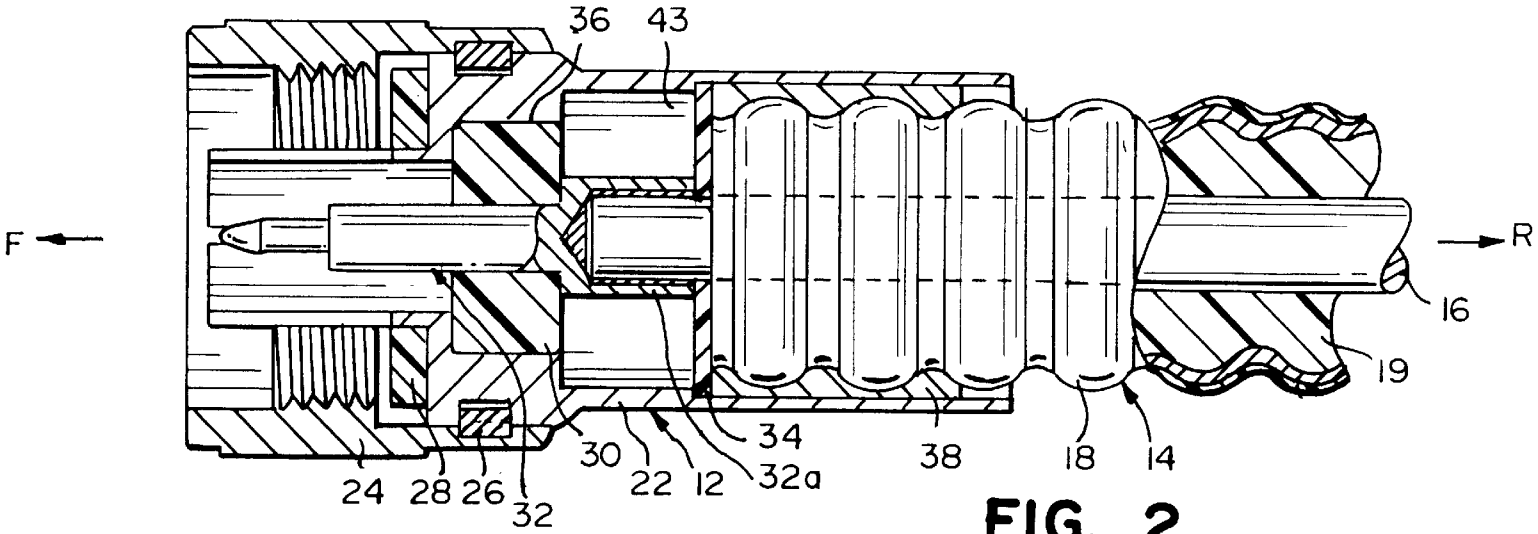
FIG. 2 is a side elevation, partially in section, of the cable assembly.
Figure 3:
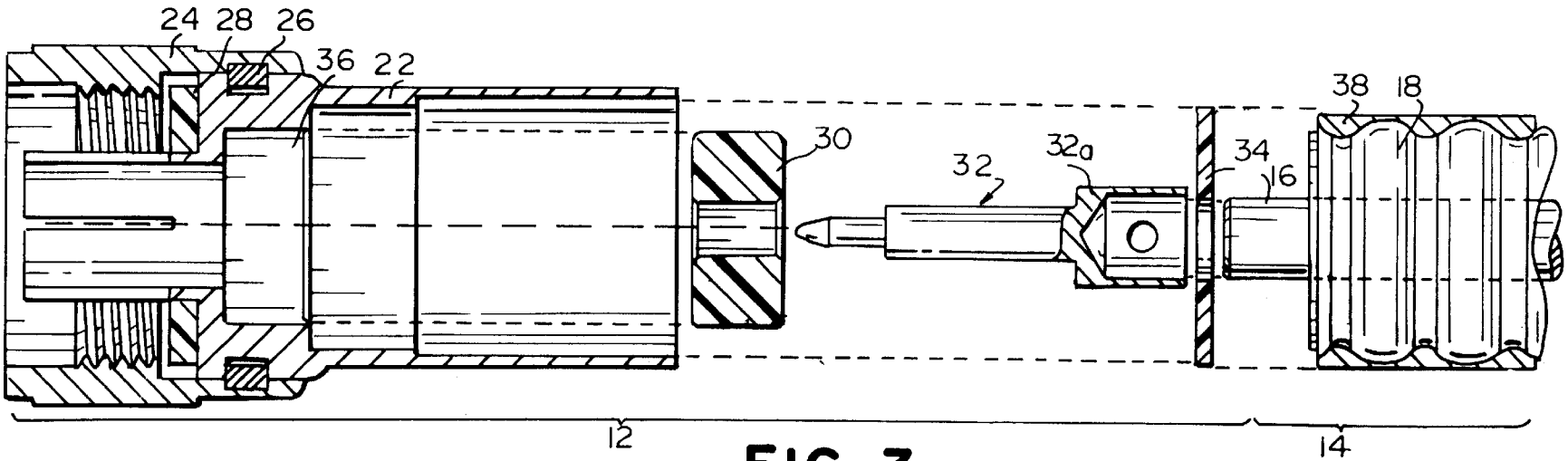
FIG. 3 is an exploded side elevation, partially in section, of the cable assembly.

As best shown in FIG. 2 (assembled view) and FIG. 3 (exploded view), the coaxial cable 14 includes inner and outer conductors 16 and 18, an air or foam dielectric 19 (FIG. 2), and a plastic jacket 20. The outer conductor 18 is concentrically spaced from the inner conductor 16 by the dielectric 19. Although the outer conductor 18 is shown as being annularly corrugated, the outer conductor 18 may alternatively be helically corrugated or braided. The plastic jacket 20 covers the outer surface of the outer conductor 18.

The connector 12 includes a conductive one-piece body member 22, a conductive coupling nut 24, a spring retaining ring 26, a gasket 28, an insulator 30, an inner contact or pin 32, and an insulative disc 34. The coupling nut 24 is a conventional fitting and is secured to the body member 22 by the spring retaining ring 26 that holds the nut 24 captive on the body member 22 while permitting free rotation of the nut 24 on the body member 22. The coupling nut 24 serves as a part of the electrical connection to the outer conductor 18 of the cable 14, and is insulated from the inner conductor 16 by the insulator 30 carried by the inner contact 32. The gasket 28 is carried by the body member 22 and is captured between the body member 22 and the coupling nut 24 to provide an insulated sealing surface for a mating connector (not shown). It is advantageous to make the body member 22 from a single piece of metal because it is less expensive and guarantees electrical and mechanical stability that could be absent from a multi-piece body member.

The inner contact 32 and the body member 22 of the connector 12 are electrically connected to the respective inner and outer conductors 16 and 18 of the cable 14. First, to effectuate electrical contact between the inner contact 32 of the connector 12 and the inner conductor 16 of the cable 14, the inner contact 32 is soldered to the inner conductor 16. The inner contact 32 includes a hollow base 32*a* that receives the exposed inner conductor 16 of the cable 14, and the inner contact 32 and the inner conductor 16 are then soldered together. The insulator 30 serves to center the inner contact 32 within the body member 22 of the connector 12 while electrically isolating these two elements from each other. The interior of the body member 22 includes a recess 36 for receiving the insulator 30. Second, to effectuate electrical contact between the body member 22 of the connector 12 and the outer conductor 18 of the cable 14, the body member 22 is soldered to the outer conductor 18. The exposed outer conductor 18 is inserted into the body member 22 with a solder preform 38 disposed therebetween, and the solder preform 38 is then melted to attach the body member 22 to the outer conductor 18.

Figure 4:
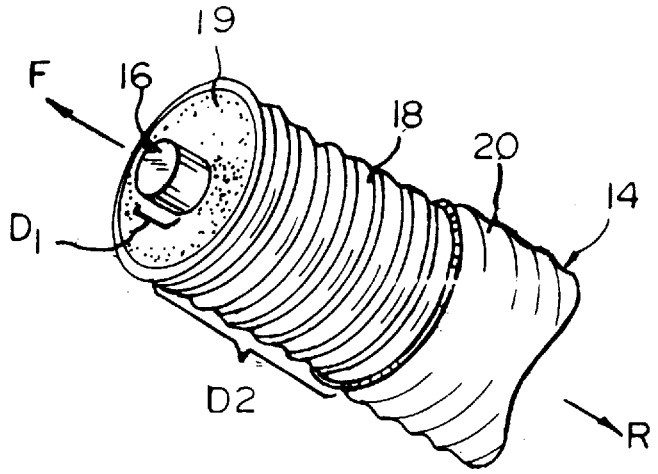
FIG. 4 is an isometric view of a prepared end of a coaxial cable.

The method of attaching the connector 12 to the coaxial cable 14 is described in detail below with reference to FIGS. 4 through 10. Referring first to FIG. 4, there is shown an end of the coaxial cable 14 that has been prepared for attachment to the connector 12. To prepare the end of the coaxial cable 14 so that it appears as shown in FIG. 4, the end of the cable 14 is first cut along a plane extending perpendicular to the axis of the cable 14 so that the foremost ends of the inner and outer conductors 16 and 18, the foam dielectric 19, and the plastic jacket 20 are flush with each other. The "forward" direction is indicated in FIG. 4 by the arrow F, while the "rearward" direction is indicated in FIG. 4 by the arrow R. The outer conductor 18, the foam dielectric 19, and the plastic jacket 20 are then stripped off to expose an end portion of the inner conductor 16 having a sufficient length $D_1$ to accommodate the inner contact 32 and the insulative disc 34 of the connector 12. Finally, the plastic jacket 20 is trimmed away from the end of the outer conductor 18 along a sufficient length $D_2$ to accommodate the connector 12. Any burrs or rough edges on the cut ends of the metal conductors are preferably removed to avoid interference with the connector 12.

Figure 5:
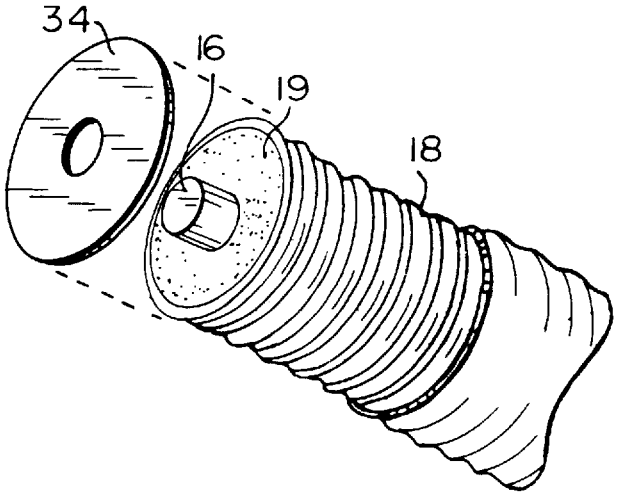
FIG. 5 is an isometric view showing an insulative disk being inserted onto the exposed inner conductor of the coaxial cable.

Referring to FIG. 5, the insulative disc 34 is installed onto the exposed end portion of the inner conductor 16 such that the rear surface of the disc 34 abuts the foremost ends of the outer conductor 18 and the dielectric foam 19. The disc 34 includes a central hole for receiving the exposed end portion of the inner conductor 16. The disc 34 is composed of a low loss dielectric material such as PTFE.

Figure 6:
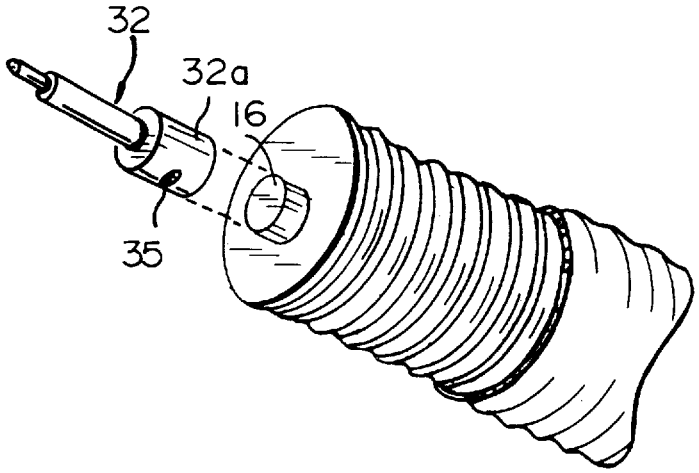
FIG. 6 is an isometric view showing an inner contact being installed onto the exposed inner conductor of the coaxial cable.

Referring to FIG. 6, the inner contact 32 is next installed onto the inner conductor 16 by inserting a small piece of solder into the hollow base 32*a* of the inner contact 32, melting the solder with a soldering iron or induction coil, and then telescoping the hollow base 32*a* over the exposed end portion of the inner conductor 16 while the solder is still in its molten state. The rearmost end of the hollow base 32*a* of the inner contact 32 abuts the front surface of the disc 34. Thus, the disc 34 is used as a solder gauge that locates the position of the inner contact 32 relative to the cable 14. An aperture 35 in the hollow base 32*a* provides an escape for overflow solder. Once the inner contact 32 is fitted onto the inner conductor 16, the molten solder quickly solidifies to fixedly attach the inner contact 32 to the inner conductor 16.

Figure 7:
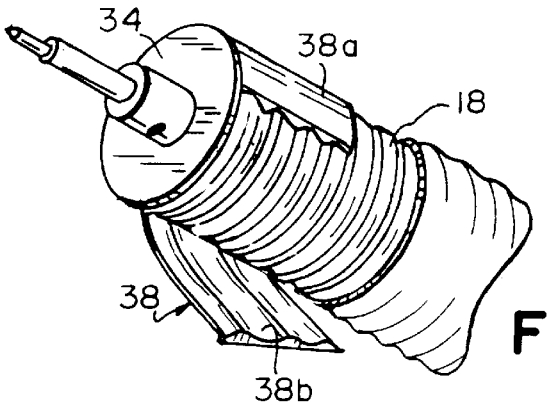
FIG. 7 is an isometric view showing a solder preform being wrapped around the exposed outer conductor of the coaxial cable.
Figure 8:
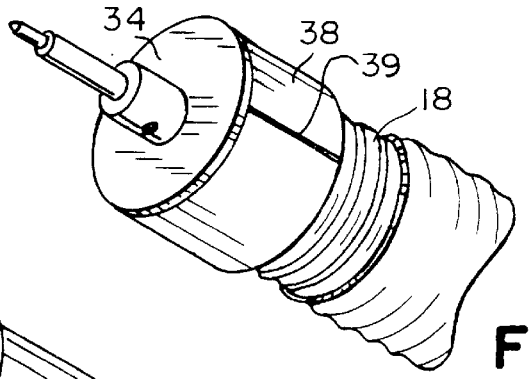
FIG. 8 is an isometric view showing the solder preform after it has been wrapped around the outer conductor of the coaxial cable.

Referring to FIG. 7, the solder preform 38 is wrapped around the exposed end portion of the outer conductor 18. The solder preform 38 is advantageous because it provides for consistent placement and quantity of solder. Such consistent placement and quantity of solder could not easily be controlled using solder injection. Prior to wrapping the solder preform 38 around the outer conductor 18, the solder preform 38 is in the form of a flat flexible strip having a planar outer surface 38*a* and a corrugated inner surface 38*b*. This flat flexible strip is initially positioned with its foremost end immediately adjacent to the rear surface of the insulative disc 34, which has a larger outer diameter than the outer conductor 18. The flat flexible strip is then manually wrapped around the outer conductor 18. To provide a snug engagement between the wrapped solder preform 38 and the outer conductor 18, the corrugations on the inner surface 38*b* of the solder preform 38 match the corrugations on the outer conductor 18. The thickness of the solder preform 38 is preferably selected such that once it is wrapped around the outer conductor 18 as shown in FIG. 8, the outer diameter of the solder preform 38 is less than or equal to the outer diameter of the disc 34. The solder preform 38 is composed of a silver-lead-tin combination which, in the preferred embodiment, consists of 3% silver. 37% lead, and 60% tin.

In an alternative embodiment, the single strip forming the solder preform 38 is replaced with a pair of semi-cylindrical strips. Each of the strips encompasses approximately one-half of the exposed end portion of the outer conductor 18, and the strips, in combination, fully encompass the exposed end portion of the outer conductor 18.

Figure 9:
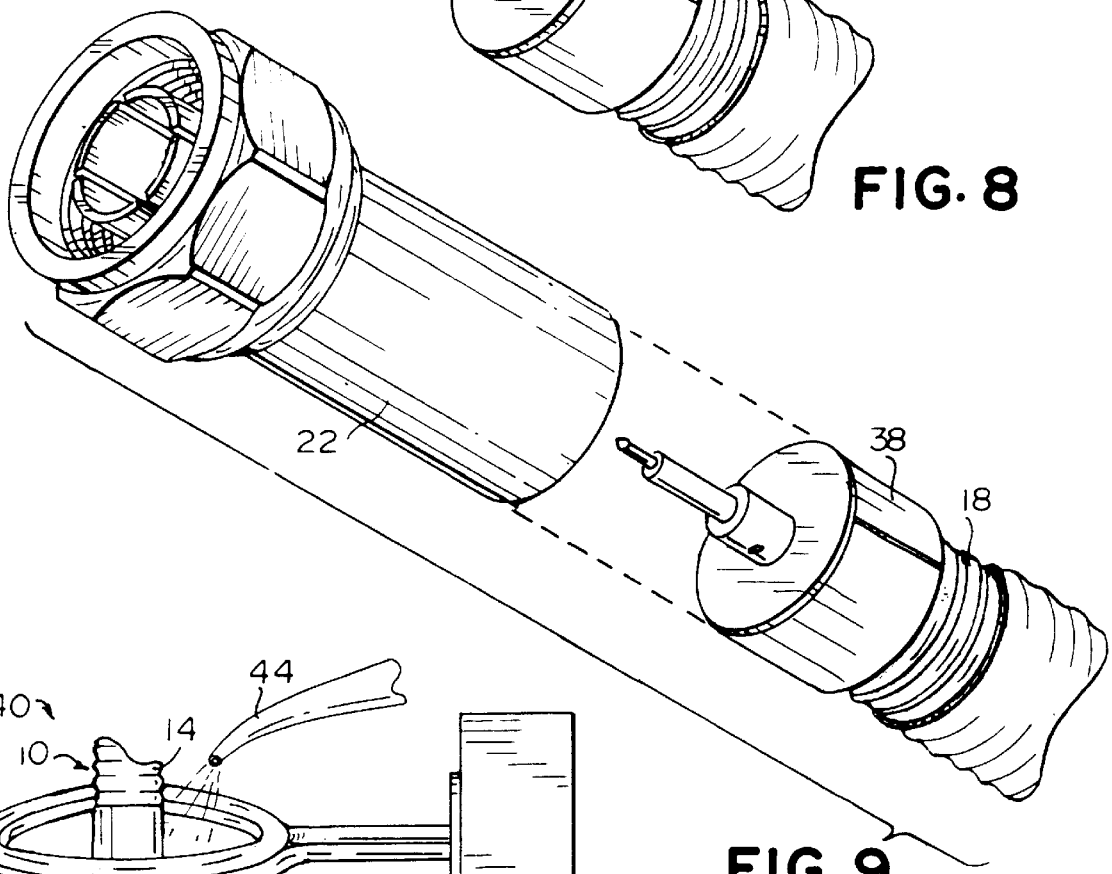
FIG. 9 is an isometric view showing a body member of a connector being installed over the solder preform that is wrapped around the exposed outer conductor of the coaxial cable.

Referring to FIG. 9, the body member 22 of the connector 12 is pushed over the solder preform 38. To insure that the solder preform 38 does not interfere with the body member 22 as it is pushed over the solder preform 38, the solder preform 38 must be tightly wrapped around the outer conductor 18 such that the outer diameter of the solder preform 38 is slightly smaller than the inner diameter of the rear portion of the body member 22. If necessary, contoured pliers may be used to compress the wrapping of the solder preform 38 prior to pushing the body member 22 over the solder preform 38.

Figure 10:
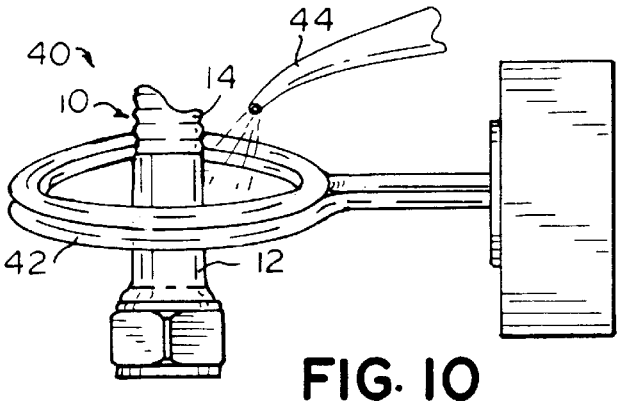
FIG. 10 is an isometric view showing the cable assembly inserted into an induction coil to melt the solder preform.

Referring to FIG. 10, the attachment of the connector 12 and the cable 14 is completed at a soldering station 40. The soldering station 40 is commercially available from Magnaforce of Warren, Ohio as model no. HS1500R. At the soldering station 40, the cable assembly 10 is inserted into and clamped by a fixture such as a vise (not shown) in a vertical position with the connector 12 located below the cable 14. Prior to soldering, the depth of the inner contact 32 relative to the body member 22 of the connector 12 is measured with a pin depth measuring device (not shown) to verify that the pin depth meets manufacturing specifications. If the pin depth does not meet the specifications, the position of the connector 12 relative to the cable 14 may be properly adjusted. The ability to measure the pin depth prior to, instead of after, completing attachment of the connector 12 to the cable 14 verifies that the connector 12 and the cable 14 are properly engaged.

After verifying the pin depth, an induction coil 42 at the soldering station 40 is activated for a period of time sufficient to melt the solder preform 38 concentrically disposed between the outer conductor 18 of the cable 14 and the body member 22 of the connector 12 without damaging the dielectric 19 (see FIG. 2). The molten solder closes the small longitudinal slot 39 (see FIG. 8) between the ends of the wrapped solder preform 38. Moreover, since the cable assembly 10 is mounted in the vertical position, the molten solder flows downward with gravity toward the insulative disc 34 (see FIG. 2) and pools around the outer conductor 18 in the area immediately behind the disc 34. The pooled solder creates a 360° circumferential seal between the outer conductor 18 of the cable 14 and the body member 22 of the connector 12. This circumferential seal creates an impenetrable moisture barrier between the connector 12 and the cable 14, thereby protecting the connector 12 from detrimental environmental conditions. The pooled solder also provides VSWR and intermodulation distortion stability to the finished cable assembly 10.

Once the molten solder contacts the unheated disc 34, the molten solder begins to cool and solidify. By cooling the molten solder, the insulative disc 34 prevents the solder from leaking into the electrical compensation zone 43 (see FIG. 2) of the connector 12. To further help cool and solidify the melted solder preform 38, the soldering cycle is followed by a cooling cycle in which a hose 44 blows cool air toward the portion of the cable assembly 10 containing the melted solder preform 38. When the soldering and cooling cycles are complete, the completed cable assembly 10 is released from the fixture.

An important advantage of the cable assembly 10 is that it provides complete mechanical captivation of the inner contact 32 of the connector 12 so that relative movement between the inner contact 32 and the body member 22 is prevented. As best shown in FIG. 2, axial movement of the inner contact 32 in the forward direction F is prevented by the abutment of the front shoulder on the hollow base 32*a* against the rear surface of the insulator 30. Similarily, axial movement of the inner contact 32 in the rearward direction R is prevented by the abutment of the rear end of the hollow base 32*a* against the front surface of the insulative disc 34. Such forward and rearward captivation insures that the depth of the inner contact 32 relative to the body member 22 remains constant over time and during bending of the cable assembly 10. Radial captivation of the inner contact 32 is supplied by the attachment of the hollow base 32*a* to the inner conductor 16 and the encirclement of the inner contact 32 by the insulator 30.

In addition to captivating the inner contact 32, the insulator 30 and the disc 34 control the depth of the inner contact 32 relative to the body member 22 during the manufacturing process. The depth of the inner contact 32 is independent of the prepared cable 14 and can easily be modified to alter electrical parameters by changing the thickness of the insulator 30 in the axial direction. It has been found that this depth can be controlled to within 0.005 inches.

The ability to control the depth of the inner contact 32 and maintain this depth over time insures proper coupling between the cable assembly 10 and a mating connector (not shown) and provides the cable assembly 10 with excellent and consistent mechanical and electrical performance. The use of solder to attach the inner contact 32 and the body member 22 to the respective inner and outer conductors 16 and 18 further enhances the performance of the cable assembly 10 by providing stable electrical and mechanical contact between the connector 12 and the cable 14. It has been found that the cable assembly 10 has excellent repeatability of VSWR measurements and has a VSWR performance better than 1.1 at frequencies under 2.3 GHz. Moreover, intermodulation distortion performance at the interface of the connector 12 and the cable 14 is exceptionally stable and generally improved.

In addition to the advantages cited above, the design of the cable assembly 10 is advantageous because it can be manufactured consistently, quickly, easily, and at a significant cost savings. The use of solder to attach the connector 12 to the inner and outer conductors of the cable 14 decreases the cycle time of the connector attachment process and obviates the need for other components, such as O-rings and expensive and bulky clamping members. Also, the design is versatile because it can be used with a wide variety of connector types, connector genders, cable constructions, and cable sizes.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A method of attaching a connector to a prepared end of a coaxial cable to form a cable assembly, said cable including concentric inner and outer conductors, said prepared end including an exposed portion of said inner conductor and an exposed portion of said outer conductor, said method comprising the steps of:

installing an insulative disc of said connector onto said exposed portion of said inner conductor;

installing an inner contact of said connector onto said exposed portion of said inner conductor;

installing a solder preform onto said exposed portion of said outer conductor;

after installing said solder preform onto said exposed portion of said outer conductor, installing a body member of said connector over said solder preform onto said exposed portion of said outer conductor, said body member encompassing said inner contact; and melting said installed solder preform to firmly attach said body member of said connector to said exposed portion of said outer conductor of said cable.

2. The method of claim 1, wherein said step of installing said inner contact occurs after said step of installing said insulative disc, said insulative disc being installed directly onto said exposed portion of said inner conductor, said installed disc abutting a foremost end of said exposed portion of said outer conductor.

3. The method of claim 1, wherein said cable includes a dielectric disposed between said inner and outer conductors of said cable, and wherein said installed disc abuts a foremost end of said dielectric.

4. The method of claim 1, wherein said inner contact includes a hollow base, and wherein said step of installing said inner contact includes inserting said exposed portion of said inner conductor into said hollow base.

5. The method of claim 1, wherein said installed solder preform abuts said insulative disc.

6. The method of claim 5, wherein said installed insulative disc abuts a foremost end of said installed solder preform.

7. The method of claim 1, further including the step of orienting said cable assembly in a vertical position with said connector substantially beneath said cable prior to said step of melting said solder preform such that in response to said step of melting said solder preform, molten solder from said solder preform flows downward with gravity toward said insulative disc and pools around said outer conductor in an area immediately behind said insulative disc.

8. The method of claim 7, wherein said step of melting said solder preform includes inserting said connector into an induction coil.

9. The method of claim 1, wherein said inner contact includes a hollow base having a front shoulder and wherein said connector includes an insulator mounted within said body member, and wherein said front shoulder of said hollow base abuts a rearmost end of said insulator.

10. The method of claim 1, wherein said connector includes an insulator mounted within said body member, and wherein said inner contact includes a hollow base having a front end in contact with said insulator and a rear end in contact with said insulative disc to substantially fix an axial position of said inner contact relative to said body member, said insulative disc being axially spaced from said insulator.

11. A method of attaching a connector to a prepared end of a coaxial cable to form a cable assembly, said cable including concentric inner and outer conductors, said prepared end including an exposed portion of said inner conductor and an exposed portion of said outer conductor, said method comprising the steps of:

installing an insulative disc of said connector onto said exposed portion of said inner conductor;

installing an inner contact of said connector onto said exposed portion of said inner conductor, said inner contact including a hollow base, said step of installing said inner contact including inserting said exposed portion of said inner conductor into said hollow base and soldering said hollow base to said exposed portion of said inner conductor;

installing a solder preform onto said exposed portion of said outer conductor;

installing a body member of said connector over said solder preform onto said exposed portion of said outer conductor, said body member encompassing said inner contact; and melting said installed solder preform to firmly attach said body member of said connector to said exposed portion of said outer conductor of said cable.

12. The method of claim 11, wherein said hollow base abuts said insulative disc.

13. A method of attaching a connector to a prepared end of a coaxial cable to form a cable assembly, said cable including concentric inner and outer conductors, said prepared end including an exposed portion of said inner conductor and an exposed portion of said outer conductor, said method comprising the steps of:

installing an insulative disc of said connector onto said exposed portion of said inner conductor;

installing an inner contact of said connector onto said exposed portion of said inner conductor;

installing a solder preform onto said exposed portion of said outer conductor by wrapping said solder preform around said exposed portion of said outer conductor;

installing a body member of said connector over said solder preform onto said exposed portion of said outer conductor, said body member encompassing said inner contact; and melting said installed solder preform to firmly attach said body member of said connector to said exposed portion of said outer conductor of said cable.

14. A method of attaching a connector to a prepared end of a coaxial cable to form a cable assembly, said cable including concentric inner and outer conductors, said prepared end including an exposed portion of said inner conductor and an exposed portion of said outer conductor, said method comprising the steps of:

installing an insulative disc of said connector onto said exposed portion of said inner conductor;

installing an inner contact of said connector onto said exposed portion of said inner conductor;

installing a solder preform onto said exposed portion of said outer conductor, said outer conductor having corrugations, said solder preform having a corrugated inner surface matching said corrugations of said outer conductor;

installing a body member of said connector over said solder preform onto said exposed portion of said outer conductor, said body member encompassing said inner contact; and melting said installed solder preform to firmly attach said body member of said connector to said exposed portion of said outer conductor of said cable.

15. A method of attaching a connector to a coaxial cable to form a cable assembly, said cable including concentric inner and outer conductors, said method comprising the steps of:

preparing an end of said cable to expose a portion of said inner conductor and to expose a portion of said outer conductor;

installing an insulative disc of said connector onto said exposed portion of said inner conductor;

installing an inner contact of said connector onto said exposed portion of said inner conductor;

installing a solder preform onto said exposed portion of said outer conductor;

after installing said solder preform onto said exposed portion of said outer conductor, installing a body member of said connector over said solder preform onto said exposed portion of said outer conductor; and melting said installed solder preform to firmly attach said body member of said connector to said exposed portion of said outer conductor of said cable.

16. The method of claim 15, further including the step of orienting said cable assembly in a vertical position with said connector beneath said cable prior to said step of melting said solder preform such that in response to said step of melting said solder preform, molten solder from said solder preform flows downward with gravity toward said insulative disc and pools around said outer conductor in an area immediately behind said insulative disc.

17. The method of claim 15, wherein said connector includes an insulator mounted within said body member, and wherein said inner contact includes a hollow base having a front end in contact with said insulator and a rear end in contact with said insulative disc to substantially fix an axial position of said inner contact relative to said body member, said insulative disc being axially spaced from said insulator.

18. A method of attaching a connector to a coaxial cable to form a cable assembly, said cable including concentric inner and outer conductors, said method comprising the steps of:

preparing an end of said cable to expose a portion of said inner conductor and to expose a portion of said outer conductor;

installing an insulative disc of said connector onto said exposed portion of said inner conductor;

installing an inner contact of said connector onto said exposed portion of said inner conductor;

installing a solder preform onto said exposed portion of said outer conductor by positioning said solder preform adjacent to said insulative disc and wrapping said solder preform around said exposed portion of said outer conductor;

installing a body member of said connector over said solder preform onto said exposed portion of said outer conductor; and melting said installed solder preform to firmly attach said body member of said connector to said exposed portion of said outer conductor of said cable.

* * * * *